US005833197A

United States Patent [19]

Peabody

[11] Patent Number: 5,833,197

[45] Date of Patent: Nov. 10, 1998

[54] PROTECTIVE COVER FOR SCUBA TANK

[76] Inventor: Steven R. Peabody, 320 W. Ash, Zionsville, Ind. 46077

[21] Appl. No.: 941,287

[22] Filed: Sep. 30, 1997

[51] Int. Cl.[6] ..... A47B 91/00; B63C 11/00

[52] U.S. Cl. ..... 248/346.01; 405/185

[58] Field of Search ..... 248/688, 346.01, 248/346.03, 246.4, 615, 146, 309.1

[56] References Cited

U.S. PATENT DOCUMENTS

| | | | |
|---|---|---|---|
| 631,182 | 8/1899 | Seelinger | 248/688 |
| 3,809,353 | 5/1974 | Good et al. | 248/346.1 |
| 3,929,312 | 12/1975 | Uke | 248/346.1 |
| 4,022,343 | 5/1977 | Richardson | 220/3 |
| 4,241,839 | 12/1980 | Algerghini | 215/100 R |
| 4,336,899 | 6/1982 | Price, II | 224/202 |
| 4,436,216 | 3/1984 | Chang | 220/69 |
| 4,792,170 | 12/1988 | Gipson et al. | 294/31.2 |
| 4,817,806 | 4/1989 | Billoud et al. | 215/12.1 |
| 5,267,815 | 12/1993 | Feder | 405/186 |
| 5,511,846 | 4/1996 | Fuller | 294/149 |

*Primary Examiner*—Leslie A. Braun
*Assistant Examiner*—Michael Nornberg
*Attorney, Agent, or Firm*—Richard L. Huff

[57] ABSTRACT

A protective container for a scuba tank. The container is made of rugged, flexible material, such as plastic or rubber. The container has an open top for placing the container over the tank, a cylindrical body for protecting the side of the tank, and a base for protecting the bottom of the tank. The upper portion of the container is tapered gently inwardly and upwardly to decrease resistance to the water. The inner surface of the container has longitudinal ribs for draining water from the top to the bottom of the container. The outer surface of the container has five longitudinal outriggers to prevent rolling of the tank when it is lying on a surface and providing the least amount of resistance to the water when the tank is in use. The container wall is extended below the base to supply protection against vertical stress when the tank is dropped. The inner surface of the base contains radial drainage channels to dispose of water inside the container. The outer surface of the base contains strengthening ribs. A central opening in the base serves as an outlet channel for water inside the container and as an inlet for an air valve which allows the easy removal of the container from the tank.

8 Claims, 4 Drawing Sheets

PROTECTIVE COVER FOR SCUBA TANK

BACKGROUND OF THE INVENTION

1. Field of the invention

This invention is directed to a lightweight, rugged, easily mountable and removable protecting container for scuba tanks.

2. Description of the related art

The prior art is aware of containers and protectors to be used with scuba tanks. Thus, U.S. Pat. No. 5,511,846 to Fuller discloses a snugly fitting bag containing handles, a woven Nylon protective bottom end, and a loose mesh upper end. This container may be used in carrying the tank or while the tank is being used. This container does little to prevent the tank from rolling if the tank is laid on its side on an inclined surface. The container offers resistance to the flow of water due to the handles and the rough mesh surfaces, thereby hampering the diver. The upper portion of the container offers no protection against scrapes and dents, and the lower portion offers only a minimum amount of protection against jarring if the tank is dropped. U.S. Pat. No. 3,809,353 to Good et al discloses a protective cap which fits on the base of a scuba tank. This cap contains ribbed walls which hold the cap in place by friction and provide for the movement of water from the top of the cap to an open bottom structure. The tank is held away from the ground surface by a flat bottom and raised reinforced arms of the cap. This cap offers no protection to the upper part of the tank. The flat surface of the upper edge of the cap offers resistance to the flow of water around the tank. This cap offers no mechanism which would prevent the tank from rolling when placed on an inclined surface. U.S. Pat. No. 3,929,312 to Use discloses a protective cap for scuba tanks. This cap contains a flange portion which extends outwardly from the top of the cap. This flange has flat edges which prevent rolling when the tank is placed on an inclined surface. This flange offers increased resistance to the flow of water and impedes the progress of the diver. The cap contains longitudinally extending ribs which serve to grip the tank and transfer water from the top of the cap to a large central opening in the base of the cap. This cap offers no protection to the upper portion of the tank. The base of the tank contains raised protective ridges which serve to raise the tank off the ground when it is put down in the vertical position, thus preventing jarring when the tank is dropped.

It is thus seen that the known prior art discloses caps which protect the lower portion of tanks against scrapes, dents, and jarring. There is also a prior art protective cap which prevents rolling. This prior art fails to disclose a container which offers protection to the upper portion of tanks against scrapes and dents. The known prior art offers increased water resistance, thereby decreasing the efficiency of the diver. Since the prior art caps are held in place by the pressure of flexible ribs, it is necessary that the caps be relatively short in order for the caps to be easily removable. If the caps of U.S. Pat. Nos. 3,809,353 and 3,929,312 were of sufficient length to protect the upper portion of the tanks, the frictional pressure would be so great as to make easy removal of the caps impossible.

SUMMARY OF THE INVENTION

The present invention seeks to retain the beneficial aspects of the known prior art, increase those benefits, and avoid the disadvantages.

This invention provides a protective container which protects substantially all of a scuba tank from scrapes and dents, prevents jarring if the tank is dropped on its bottom, and prevents rolling if the tank is left on an inclined surface. The container is easy to mount onto the tank and easy to remove. The container is made of rugged, flexible plastic or rubber. It has an open end for placing the container over a tank, a cylindrical hollow body for protecting substantially the entire side of the tank, and a raised base which offers increased protection against jarring, a central opening in the base to serve as an egress for water which is between the tank and the container and for forcibly inserting air to loosen the container from the tank for easy removal.

The upper portion of the container is tapered gently inwardly and upwardly to provide a smooth connection between the tank and the container in order to decrease water resistance. The inner surface of the container has multiple longitudinal ribs for draining water from the top to the bottom of the container. The outer surface of the container contains four to six longitudinal outriggers to prevent the tank from rolling if left on an inclined surface. These outriggers create minimal resistance to water, and thus do not impede the diver.

At the bottom of the container, the outer surface of the container extends beyond the base of the container to allow the tank to stand on end and to prevent jarring to the tank in the event of accidental dropping. There is a circumferential channel at the inner surface of the base of the container. Also, the inner surface of the base contains radial drainage channels to convey water from the circumferential channel to a centrally located drainage opening so that there is no water left between the container and the tank when the tank is stored. The central opening additionally provides access to an air valve which permits air to be forced between the container and the tank to loosen the container and allow easy removal thereof. The outer surface of the base contains strengthening ribs to provide structural support, allow the tank to be stored on end, and to avoid injury to the tank following dropping of the tank.

It can be readily seen that the container of the present invention provides unexpected beneficial results compared to the caps of the known prior art.

DESCRIPTION OF THE PREFERRED EMBODIMENTS

Figure 1:
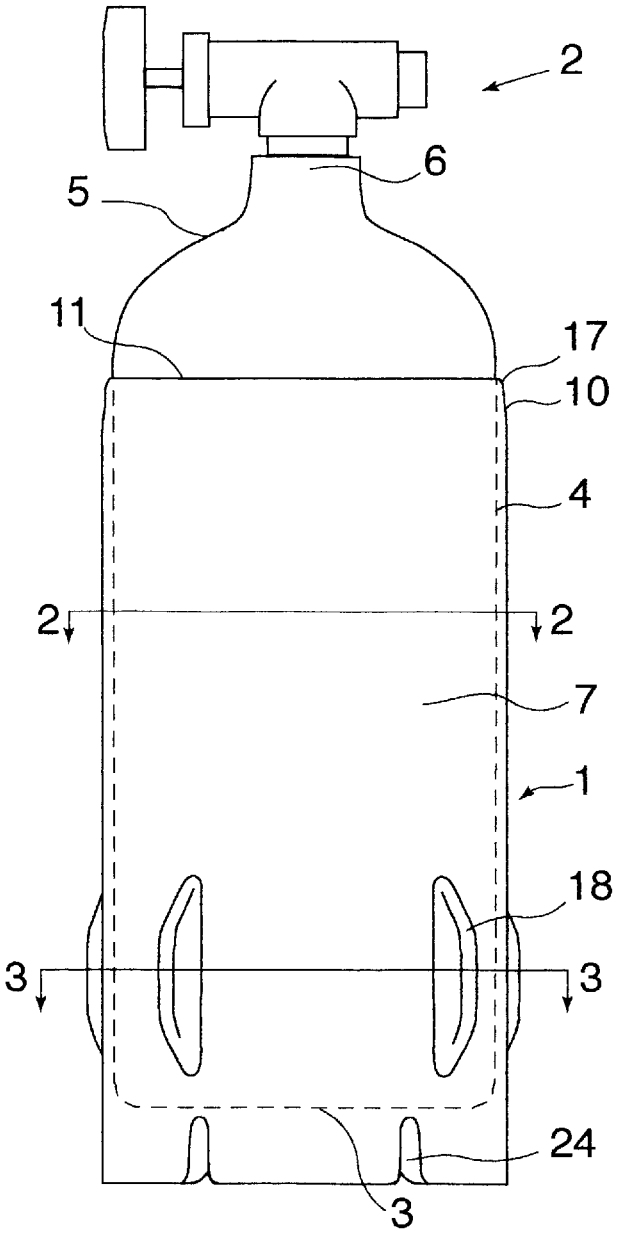
FIG. 1 elevational side view of the container in place on a scuba tank.
Figure 2:
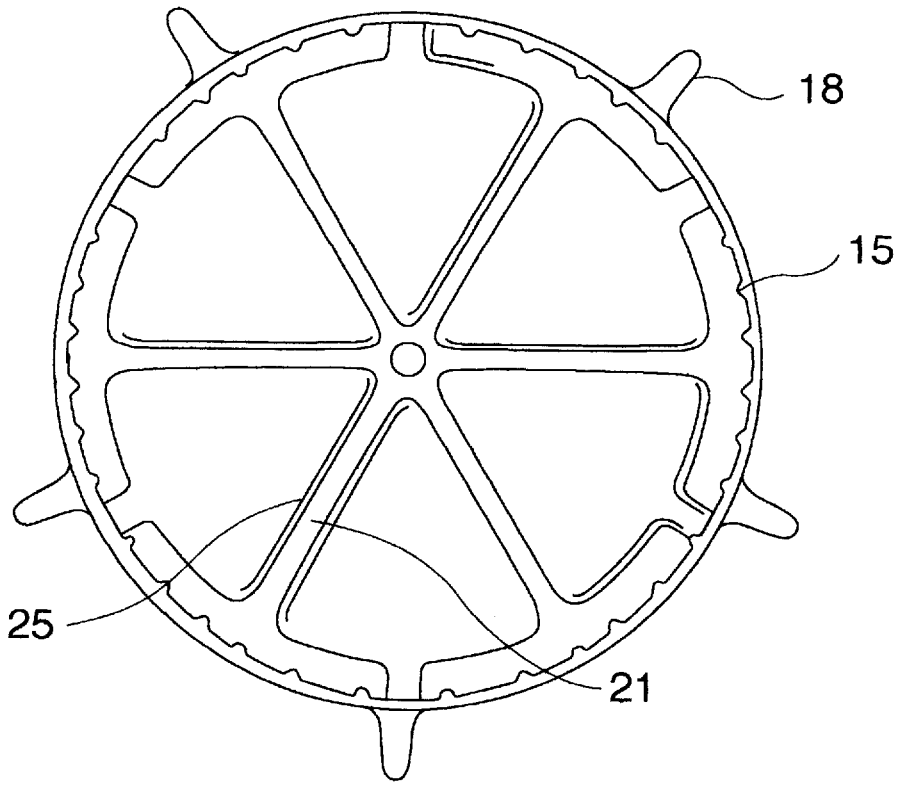
FIG. 2 is a horizontal cross-sectional view of the container taken along line 2—2 of the container of FIG. 1.
Figure 3:
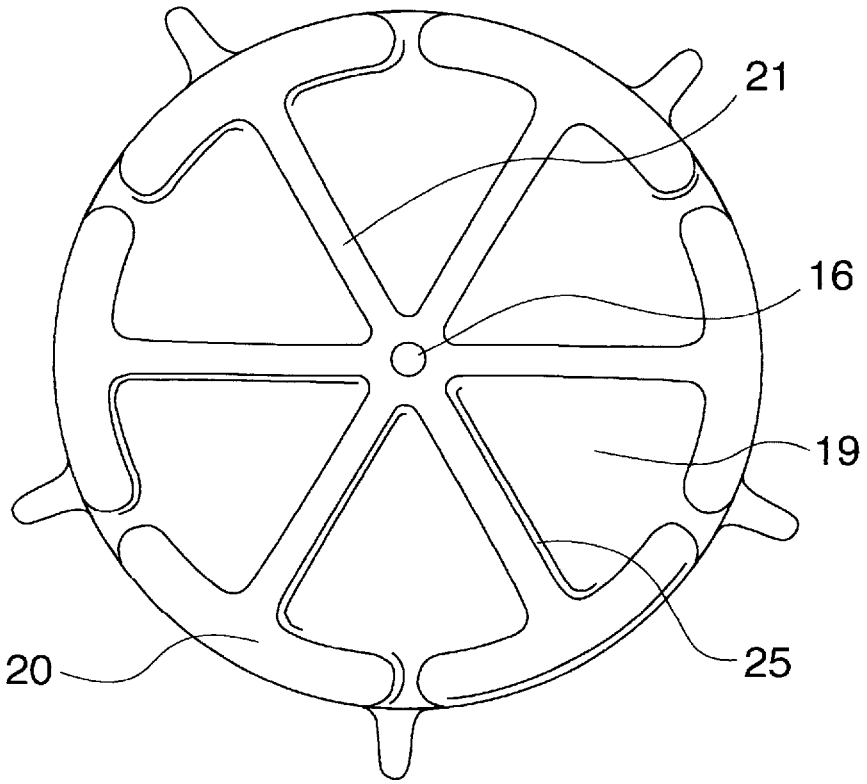
FIG. 3 is a horizontal cross-sectional view of the container taken along line 3—3 of the container of FIG. 1
Figure 4:
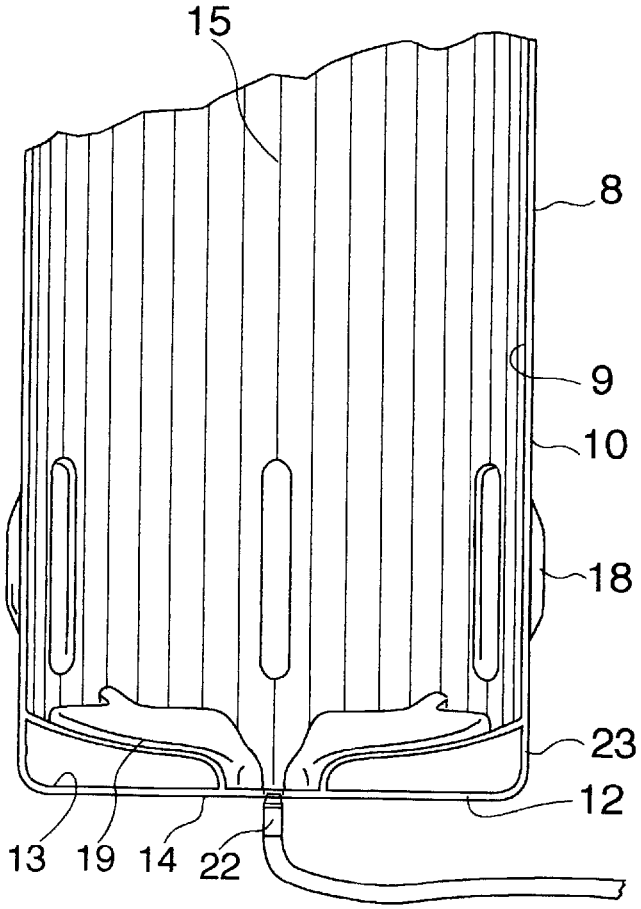
FIG. 4 is a vertical cross-sectional view of the base of the container taken along line 4—4 of FIG. 3.

The invention will now be described with reference to the above Figures, like numbers referring to like features throughout the description.

The container 1 of the present invention is designed to protect a scuba tank 2 which has a bottom 3, a cylindrical body 4, a shoulder portion 5, and a neck 6. Protection against scrapes, dents, jarring and rolling is accomplished while the tank 2 is in use in the water as well as out of the water.

The container 1 is made of tough, resilient material such a neoprene rubber, polyvinyl chloride, or polyolefins, such as polyethylene. The material should be selected for its ability to present a smooth surface which will allow flow through water without presenting resistance to water flow. The material must be tough and resistant to being scraped or cut. It must be capable of absorbing shock so as to lessen sudden stress on the tank if the tank is accidentally dropped. The material should also be capable of holding bright colors in order to make the container more visible under water.

The container 1 has a substantially cylindrical hollow body 7 which has a length and a radius. The hollow body 7 is made up of a vertical wall 8 having interior 9 and exterior 10 surfaces, a top opening 11, and a bottom wall 12 having interior 13 and exterior 14 surfaces.

Scuba tanks 2 come in a variety of standard sizes. Individual tanks may vary in size or shape depending on surface coatings or the presence of dents. Because of the resiliency of the material of the container 1, the containers 1 for a given standard tank 2 size will fit over tanks 2 of the corresponding size. The body length of the container 1 is such that, when in use, the container 1 fits over substantially all of the body 4 of the tank 2.

The interior surface 9 of the vertical wall 8 of the container 1 contains a plurality (100±20) longitudinal ribs 15. The raised portions of the ribs may be of any desirable cross-sectional shape, such as rectangular, triangular, or semicircular. The prefered shape is rectangular. The longitudinal ribs 15 have a plurality of purposes. They serve to conduct water which is between the container 1 and the tank 2 to the interior surface 13 of the bottom wall 12 of the container 1 to be discharged from the central opening 16. Another purpose of the longitudinal ribs 15 is maintaining a snug fit between the tank 2 and the container 1 while allowing for entrance of pressurized air which is used to remove the container 1.

The exterior surface 10 of the vertical wall 8 contains a gentle slope 17 inwardly and upwardly in order to decrease the water resistance caused by the container 1. The slope 17 may be from 2°–10°, preferably 6°. The outer surface of the container 1 contains a plurality, preferably 4–6, most preferably 5, longitudinal outriggers 18. The purpose of the outriggers 18 is to prevent rolling of the tank 2 when the tank 2 is placed on an inclined surface. The outriggers 18 may be placed anywhere along the exterior surface 10 of the vertical wall 8 of the container 1, but are preferably equally spaced around the circumference of the container 1 adjacent a raised base 19 for supporting the scuba tank 2. The outriggers 18 are longitudinal in nature to cause minimal water resistance.

The interior surface 13 of the bottom wall 12 of the container 1 contains a circumferential channel 20 surrounding the raised base 19. The interior surface 13 of the bottom wall 12 further contains a plurality, preferably 4–8, most preferably 6, of inwardly and downwardly sloping drainage channels 21 through the raised base 19 capable of carrying water from the circumferential channel 20 to the central opening 16 for draining from the interior of the container 1.

The central opening 16 is preferably 2–15 mm in diameter, most preferably 10 mm. In addition to serving as a draining mechanism for the water between the container 1 and the tank 2, the central opening 16 provides a mechanism for the introduction of a valve 22 attached to a source (not shown) of compressed air. The compressed air forces the container 1 away from the tank 2, enabling easy removal of the container 1.

The exterior surface 14 of the bottom wall 12 abuts with a circumferential extension 23 of the vertical wall 8 containing a plurality, preferably 5–7, most preferably 6, of longitudinal openings 24 which permit the escape of water drained from inside the container 1. The extension 23 protrudes below the bottom wall 12 of the container 1 and allows the container 1 to absorb shock forces in the event the container 1 and tank 2 are accidentally dropped. Also, the outer surface 13 of the bottom wall 12 of the container 1 has a plurality, preferably 4–8, most preferably 6, of radial support ribs 25 to add strength to the bottom wall 12.

It is apparent that obvious modifications may be made in the invention as described. It is the inventor's position that such modifications be included within the scope of the invention, which is to be limited by the scope of the amended claims.

I claim:

1. A protective cover for a scuba tank, which tank has a bottom, a cylindrical body, a shoulder portion, and a neck, which cover is made of resilient material and comprises a substantially cylindrical hollow body having a length and a radius, and has a vertical wall having interior and exterior surfaces, a top opening, and a bottom wall having interior and exterior surfaces, wherein:

the body length is such that, when in use, the protective cover fits over substantially all of the body of the scuba tank;

the radius is such that, when in use, the protective cover is held on the body of the scuba tank by a snug friction fit;

the interior wall contains a plurality of longitudinal ribs;

the exterior wall contains a plurality of longitudinal outriggers;

the inner surface of the bottom wall has a raised base for supporting the scuba tank, a circumferential channel between the raised base and the vertical wall, a plurality of inwardly and downwardly sloping drainage channels, and an inner aspect of a central opening having a diameter of 2–15 mm; and the outer surface of the bottom wall abuts with a circumferential extension of the side wall containing a plurality of longitudinal openings and contains a plurality of radial support ribs and the outer aspect of the central opening.

2. The protective cover of claim 1, wherein the cylndrical hollow body tapers upwardly and inwardly adjacent the top opening.

3. The protective cover of claim 1, wherein the longitudinal ribs are projections of the interior wall.

4. The protective cover of claim 3, wherein the longitudinal ribs are rectangular in cross-section.

5. The protective cover of claim 1, wherein there are five longitudinal outriggers equally spaced around the cylindrical hollow body.

6. The protective cover of claim 5, wherein the longitudinal outriggers are adjacent to the raised base.

7. The protective cover of claim 1, wherein the inner surface of the bottom wall contains six drainage channels equally spaced around the circumference of the body and extending from the circumferential channel at the inner surface of the cylindrical wall to the central opening.

8. The protective cover of claim 1, wherein the central opening is 10 mm in diameter.

* * * * *